United States Patent [19]

Wu

[11] 4,244,907

[45] Jan. 13, 1981

[54] SPIN-TEXTURE PROCESS

[75] Inventor: Wen-li Wu, Pensacola, Fla.

[73] Assignee: Monsanto Company, St. Louis, Mo.

[21] Appl. No.: 93,082

[22] Filed: Nov. 8, 1979

Related U.S. Application Data

[63] Continuation of Ser. No. 918,908, Jun. 26, 1978, abandoned.

[51] Int. Cl.[3] ..... D01D 5/22

[52] U.S. Cl. ..... 264/168; 264/210.5; 264/210.8

[58] Field of Search ..... 264/168, 210.5, 210.8

[56] References Cited

U.S. PATENT DOCUMENTS

| | | | |
|---|---|---|---|
| 3,832,435 | 8/1974 | Bayer et al. | 264/168 |
| 3,840,633 | 10/1974 | Barbe et al. | 264/210.8 |

FOREIGN PATENT DOCUMENTS

| | | | |
|---|---|---|---|
| 2155207 | 5/1972 | Fed. Rep. of Germany | 264/237 |
| 1145727 | 10/1957 | France | 264/168 |
| 42-11685 | 7/1967 | Japan | 264/210.8 |
| 47-36457 | 9/1972 | Japan | 57/157 TS |

*Primary Examiner*—Jay H. Woo
*Attorney, Agent, or Firm*—John W. Whisler

[57] ABSTRACT

A spin-texture process for producing crimped synthetic filaments is described in which freshly extruded filaments are passed over a 20° C.–180° C. roll before they are completely solidified and fully drawn as they leave the roll. In the case of polyamide filaments, spontaneous crimp as well as latent crimp is observed.

5 Claims, 1 Drawing Figure

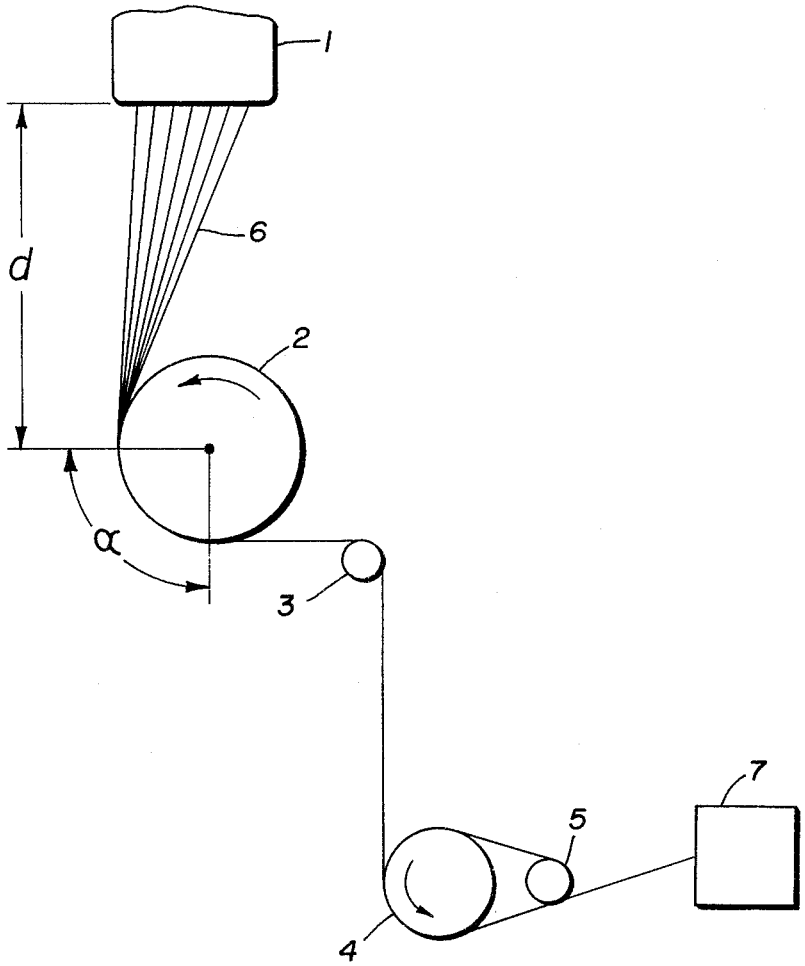
1
6
d
2
α
3
7
5
4

SPIN-TEXTURE PROCESS

This is a continuation of application Ser. No. 918,908 filed June 26, 1978, now abandoned.

BACKGROUND OF THE INVENTION

A. Field of the Invention

This invention relates to a novel spin-draw process for producing fully drawn melt spun synthetic filaments, such as, polyester and polyamide filaments, having useful spontaneous crimp and/or latent crimp.

As used herein: the term "spontaneous crimp" means crimp observed upon release at ambient temperatures of the tension applied to the filaments during the drawing thereof; the term "latent crimp" means crimp which is not observed even upon release of the drawing tension until the filaments are subjected to heat while relaxed; the term "crimp" means crimp resulting from the additive effect of both spontaneous and latent crimps; the terms "% hot bulk" and "% cold bulk" are defined by the equation:

$$\% \text{ Bulk} = \frac{L_1 - L_2}{L_1} \times 100$$

where the vertical length ($L_2$) of a sample of filaments having a length ($L_1$) (e.g. 25.4 cm) when fully extended (straight) is measured while being maintained in the vertical position by means of a clamp at the upper end of the sample and a weight of 0.0009 grams per denier attached to the lower end. In determining % hot bulk $L_2$ is determined after the sample has been exposed to 180° C. dry heat for five minutes followed by cooling at ambient conditions for one minute. In determining % cold bulk $L_2$ is measured without the sample being first exposed to dry heat. Unless otherwise stated herein the term "% bulk" has reference to % hot bulk. Cold bulk is a measure of spontaneous crimp while hot bulk is a measure of both spontaneous and latent crimps.

B. Description of the Prior Art

U.S. Pat. No. 3,832,435 describes a melt spinning process for producing partially drawn polyester filaments having latent crimp. Latent crimp is imparted to the filaments after they leave the spinneret by cooling the freshly spun filaments on one side before they completely solidify. The cooling is accomplished by passing the individual filaments over a cooled roll (quench roll) driven at a given peripheral speed. The yarn is passed from the quench roll over a second cooled roll of smaller diameter which is normally stationary or substantially stationary when compared to the speed of the first roll. The filaments are pulled from the second roll at a speed such that they are partially drawn as they leave the second roll. The partially drawn filaments prepared by this process must be further drawn in a separate operation and then heated to develop the latent crimp.

It is an object of the present invention to provide a simpler, more economical process for producing polyester filaments having a latent crimp.

It is another object of the invention to provide a process for producing in one operation fully drawn polyester filaments having latent crimp.

It is still another object of the invention to provide a process which is also useful for imparting both latent crimp and spontaneous crimp to other melt spun synthetic filaments, such as polyamide filaments.

SUMMARY OF THE INVENTION

The foregoing objects are accomplished by the spin-draw process of the present invention. In general, the process involves imparting spontaneous crimp and/or latent crimp to freshly extruded melt spun filaments by passing such filaments before they become completely solidified over a quenching roll, thereby cooling the filaments on one side, and then fully drawing the filaments as they leave the quenching roll. More specifically the process comprises:

(a) extruding a fiber-forming synthetic polymer through orifices of a spinneret at an extrusion rate ($E_R$) to form filaments which cool as they move away from the spinneret, (b) passing the filaments before they are completely solidified over a quenching with a wrap angle ($\alpha$), wherein said roll is rotating at a peripheral speed ($S_1$), is maintained at a surface temperature ($T_R$) and is positioned a distance (d) from the spinneret so that the filaments do not stick to one another when in contact with said roll and wherein on the average ($T_R$) is lower than the temperature at the center of the filaments, and (c) drawing the filament at a draw ratio (DR) as they leave said roll by withdrawing the filaments from said roll at a speed ($S_2$) which is greater than ($S_1$), wherein angle ($\alpha$) is of sufficient magnitude to prevent significant slippage of the filaments on said roll, wherein ($E_R$), ($T_R$), (d) and (DR) are correlated to provide filaments having spontaneous and/or latent crimp and a bulk of at least 10% and preferably at least 18% when exposed to 180° C. dry heat for five minutes while relaxed followed by cooling. The resultant filaments have mechanical properties comparable to those of other fully drawn yarns, e.g. tenacities ranging from 2 to 5 grams/denier and elongations ranging from 12 to 35%.

In general, with all other processing conditions and denier per filament (dpf) being held the same the following relationships exists:

(1) as distance (d) increases, the bulk level increases through a maximum value and thereafter decreases, (2) as the extrusion rate ($E_R$) increase, distance (d) at which maximum bulk is obtained also increases, (3) as the draw ratio increases, the bulk level increases and (4) as the surface temperature of the cooled roll increases, the bulk level decreases.

The process of this invention may be used in producing textured melt spun synthetic filaments such as those melt spun from polyethylene terephthalate (PET) and polyhexamethylene adipamide (nylon 66). Nylon 66 filaments produced by the process of this invention not only have latent crimp but in many instances also have a significant amount of spontaneous crimp.

BRIEF DESCRIPTION OF THE DRAWING

The FIGURE is a schematic elevation view of an apparatus arrangement suitable for use in carrying out the process of this invention.

DESCRIPTION OF THE PREFERRED EMBODIMENTS

From the standpoint of commercial considerations the process of this invention may be suitably used in producing commercial polyester (e.g. PET) and polyamide (e.g. Nylon 66) yarns where a bulk in the range of from 10% to 50% is desired. However, the process can be operated such that yarns having less bulk (e.g. 5%) or greater bulk (e.g. 80%) are obtained.

In a preferred embodiment of the invention, the process is carried out using the apparatus arrangement shown in the FIGURE Referring to the FIGURE, molten fiber-forming polyester or nylon of textile grade is extruded through orifices of spinneret 1 at a given extrusion rate ($E_R$) to provide filaments 6. The filaments before they have completely solidified and after their surface has cooled to a temperature below their stick temperature are passed over quench roll 2. Roll 2 is driven at a given peripheral speed ($S_1$) and maintained at a temperature ($T_R$) below the average temperature at the center of the filaments. The filaments, after contacting the surface of roll 2 through a contact angle ($\alpha$), are passed over free rolling roll 3 (idler roll), then around draw roll 4 and it's associated separator roll 5, with several wraps and, finally, are packaged by take-up device 7, such as, by being wound onto a bobbin. Angle ($\alpha$) must be large enough so that no significant slippage of the filaments occurs on roll 2. Conveniently, contact angle ($\alpha$) can be changed by moving roll 3 up or down. Draw roll 4 is driven at a peripheral speed ($S_2$) greater than ($S_1$) and the filaments are drawn as they leave roll 2. The extrusion rate ($E_R$), distance (d), temperature ($T_R$) of roll 2, and ($S_1$) and ($S_2$) and draw ratio (DR) are correlated to give the desired level of crimp and denier per filament. Usually, roll 2 is maintained at a temperature ranging from 20° to about 180° C. with a range of 30° to 100° C. being particularly useful. The roll may be cooled by conventional means such as by cooled air or nitrogen. While lower temperatures may be satisfactorily used, the cost of refrigeration of the roll renders such temperatures economically unattractive. Draw ratios usually range from 1.5:1 to 6:1.

Although not necessary, cooling air may be directed, if desired, onto the filaments between the spinneret and roll 2 to assist in quenching the filaments. Also, spinnerets may be used which have orifices of either round or nonround cross-section. In other words, it is not necessary in carrying out the process of this invention that the filaments be of a nonround cross-section in order that a crimp be imparted thereto.

The following examples are given to further illustrate the invention.

EXAMPLES 1–38

In these examples polyhexamethylene adipamide (nylon 66) yarns having crimp were prepared using the apparatus arrangement shown in the FIGURE. Commercial grade nylon 66 was melted and extruded through a spinneret having 6 orifices of round cross-section measuring 9 mils (0.023 mm)×12 mils (0.030 mm). The spinneret was maintained at 275° C. Driven quench roll 2 had a diameter of 2 inches (5.08 cm). Processing parameters were varied from example to example as specified in Table I. In the table, ($E_R$) is the extrusion rate in grams/min., (d) is the distance in cm between the quench roll and the spinneret, ($S_1$) is the peripheral speed of the quench roll in m/min., ($S_2$) is the peripheral speed of the draw roll (roll 4 in the FIGURE) in m/min., dpf is the final denier per filament of the yarn.

TABLE I

| Example | $E_R$ | Quench Roll Temp, °C. | d | $S_1$ | $S_2$ | Draw Ratio | dpf | Bulk, % Cold | Bulk, % Hot |
|---|---|---|---|---|---|---|---|---|---|
| 1 | 5.1 | 50 | 40.64 | 163.4 | 369.1 | 2.26 | 20.73 | 46.97 | 46.03 |
| 2 | 5.1 | 50 | 40.64 | 233.5 | 369.1 | 1.58 | 20.73 | 2.21 | 20.05 |
| 3 | 5.1 | 50 | 40.64 | 204.2 | 731.5 | 3.58 | 10.46 | 6.72 | 45.12 |
| 4 | 5.1 | 50 | 40.64 | 292 | 731.5 | 2.50 | 10.46 | 3.34 | 15.31 |
| 5 | 5.1 | 100 | 40.64 | 150.3 | 365.8 | 2.43 | 20.92 | 2.21 | 30.89 |
| 6 | 5.1 | 100 | 40.64 | 214.9 | 365.8 | 1.76 | 20.92 | 1.76 | 6.96 |
| 7 | 5.1 | 100 | 40.64 | 215.8 | 731.5 | 3.39 | 10.46 | 14.18 | 36.09 |
| 8 | 5.1 | 100 | 40.64 | 310.9 | 731.5 | 2.35 | 10.46 | 11.92 | 33.15 |
| 9 | 5.1 | 150 | 40.64 | 178.6 | 365.8 | 2.05 | 20.92 | 2.89 | 31.57 |
| 10 | 5.1 | 150 | 40.64 | 255.4 | 365.8 | 1.45 | 20.92 | 0.63 | 5.83 |
| 11 | 5.1 | 150 | 40.64 | 246.6 | 731.5 | 2.97 | 10.46 | 4.47 | 27.96 |
| 12 | 5.1 | 150 | 40.64 | 364.2 | 731.5 | 2.01 | 10.46 | 2.89 | 15.99 |
| 13 | 5.0 | 50 | 24.14 | 104.9 | 365.8 | 3.49 | 20.51 | 1.76 | 7.18 |
| 14 | 5.0 | 50 | 24.13 | 150.0 | 365.8 | 2.43 | 20.51 | 1.08 | 3.57 |
| 15 | 5.0 | 50 | 24.13 | 235.3 | 731.5 | 3.11 | 10.25 | 6.05 | 34.06 |
| 16 | 5.0 | 50 | 24.13 | 333.8 | 731.5 | 2.19 | 10.25 | 1.08 | 13.28 |
| 17 | 5.0 | 100 | 24.13 | 132.0 | 365.8 | 2.77 | 20.51 | 4.92 | 26.15 |
| 18 | 5.0 | 100 | 24.13 | 188.7 | 365.8 | 1.94 | 20.51 | 0.63 | 3.57 |
| 19 | 5.0 | 100 | 24.13 | 250.0 | 731.5 | 2.93 | 10.25 | 1.54 | 8.54 |
| 20 | 5.0 | 100 | 24.13 | 340.5 | 731.5 | 2.15 | 10.25 | 0.86 | 4.87 |
| 21 | 5.0 | 150 | 24.13 | 231.0 | 365.8 | 1.58 | 20.51 | 0.63 | 2.89 |
| 22 | 5.0 | 150 | 24.13 | 247.2 | 731.5 | 2.96 | 10.25 | 3.79 | 14.18 |
| 23 | 5.1 | 80 | 30.46 | 157.6 | 365.8 | 2.32 | 20.92 | 0.63 | 6.96 |
| 24 | 5.1 | 65 | 30.48 | 124.1 | 365.8 | 2.95 | 20.92 | 0.63 | 6.96 |
| 25 | 5.1 | 65 | 30.48 | 124.1 | 365.8 | 2.95 | 20.92 | 0.86 | 12.83 |
| 26 | 5.1 | 65 | 30.48 | 137.2 | 459.3 | 3.35 | 16.66 | 3.12 | 30.67 |
| 27 | 5.1 | 50 | 30.48 | 193.9 | 781.5 | 4.03 | 9.79 | 52.35 | 70.87 |
| 28 | 5.1 | 60 | 30.48 | 193.9 | 782.7 | 4.04 | 9.77 | 36.09 | 68.16 |
| 29 | 5.1 | 50 | 30.48 | 188.4 | 780.9 | 4.14 | 9.80 | 7.86 | 64.10 |
| 30 | 5.1 | 50 | 30.48 | 171.9 | 781.5 | 4.54 | 9.79 | 7.18 | 62.74 |
| 31 | 5.1 | 30 | 30.48 | 193.5 | 731.5 | 3.78 | 10.46 | 19.15 | 67.71 |
| 32 | 5.1 | 30 | 30.48 | 195.1 | 782.7 | 4.00 | 9.80 | 37.44 | 71.54 |
| 33 | 5.2 | 50 | 30.48 | 193.9 | 787.9 | 4.06 | 9.90 | 37.90 | 68.61 |
| 34 | 5.2 | 50 | 30.48 | 176.2 | 787.9 | 4.47 | 9.90 | 52.80 | 72.00 |
| 35 | 10.4 | 50 | 30.48 | 322.2 | 1442.6 | 4.48 | 10.82 | 2.67 | 15.76 |
| 36 | 7.6 | 50 | 30.48 | 265.2 | 1182.0 | 4.46 | 9.65 | 1.54 | 10.12 |
| 37 | 7.6 | 50 | 40.64 | 265.2 | 1182.0 | 4.46 | 9.65 | 49.87 | 72.67 |

TABLE I-continued

| Example | $E_R$ | Quench Roll Temp, °C. | d | $S_1$ | $S_2$ | Draw Ratio | dpf | Bulk, % Cold | Bulk, % Hot |
|---|---|---|---|---|---|---|---|---|---|
| 38 | 10.2 | 50 | 40.64 | 321.0 | 1441.4 | 4.49 | 10.62 | 2.66 | 21.64 |

The effect of distance (d) on bulk level with the other process parameters being held the same is illustrated by comparing the results of examples 3,15 and 27. In these examples the bulk level is a maximum when (d) is equal to 30.48 cm ($E_R$)=5.0-5.1 g/min. ($T_R$)=50° C., ($S_2$)=731.5-792.5 m/min and (DR)=3.0-4.0. When the extrusion rate is increased from 5.0 to 7.6 grams per minute, filaments of higher bulk are obtained when (d) is equal to 40.64 cm instead of 30.48 cm as demonstrated by example 36 and 37, thus, showing the interrelationship existing between (d) and ($E_R$).

The effect of extrusion rate ($E_R$) on bulk level with the other process parameter being held the same is illustrated by the following two sets of the examples. Examples 27, 36 and 35 demonstrate that over the extrusion rate of from 5.1 to 10.2 grams per minute the bulk level reaches its maximum at ($E_R$)=5.1 grams per minute with (d)=30.48 cm, ($T_R$)=50° C., and with ($S_2$) changing linearly with the extrusion rate. Examples 3, 37 and 38 demonstrate that the maximum bulk level occurs at the extrusion rate ($E_R$)=7.6 grams per minute as the distance (d) changes from 30.48 cm to 40.64 cm. The above examples also illustrate that the optimum values for the extrusion rate and the distance (d) are clearly interrelated.

The effect of the quench roll temperature ($T_R$) on the bulk level is illustrated by examples 3, 7 and 11. These examples indicate that over the quench roll temperature range of from 50° to 150° C., the filaments obtained when ($T_R$)=50° C. have the highest bulk level with ($E_R$)=5.1, grams/min., (d)=40.64 cm, ($S_2$)=731.5 m/min. and (DR)=3.0-3.6. The trend of the lower the quench roll temperature the higher the bulk level is also apparent by comparing the results of examples 15, 19 and 22.

The effect of the draw ratio (DR) on the bulk level is illustrated by comparing the results of the following pairs of examples: 1 and 2, 3 and 4, 5 and 6, 7 and 8, etc. These examples indicate that with the other process parameters being held the same the bulk level increases as the draw ratio increases.

EXAMPLES 39-49

In these examples polyethylene terephthalate (PET) yarns having latent crimp were prepared from commercial grade fiber-forming PET polymer using the apparatus and procedure described for examples 1-38. In these examples the spinneret described in the preceding examples was maintained at 290° C. and distance (d) was 12 inches (30.48 cm). Process parameters were varied from example to example as indicated in Table II.

TABLE 2

| Example | $E_R$ | Quench Roll Temp. °C. | $S_1$ | $S_2$ | Draw Ratio | dpf | % Hot Bulk |
|---|---|---|---|---|---|---|---|
| 39 | 4.7 | 50 | 110.9 | 365.8 | 3.30 | 19.27 | 76.06 |
| 40 | 4.7 | 50 | 152.4 | 758.6 | 4.98 | 9.29 | 71.77 |
| 41 | 4.7 | 60 | 152.4 | 764.1 | 5.01 | 9.22 | 59.35 |
| 42 | 4.7 | 70 | 152.4 | 761.7 | 5.00 | 9.25 | 60.93 |
| 43 | 4.7 | 80 | 152.4 | 762.0 | 5.00 | 9.25 | 69.74 |
| 44 | 4.7 | 90 | 152.4 | 762.0 | 5.00 | 9.25 | 62.51 |
| 45 | 4.7 | 100 | 152.4 | 762.0 | 5.00 | 9.25 | 51.22 |
| 46 | 7.5 | 50 | 274.3 | 1145.7 | 4.18 | 9.82 | 79.00 |
| 47 | 10.2 | 50 | 335.0 | 1441.4 | 4.30 | 10.61 | 64.32 |
| 48 | 10.2 | 50 | 288.3 | 1441.4 | 5.00 | 10.61 | 20.96 |
| 49 | 10.2 | 50 | 246.9 | 1441.4 | 5.84 | 10.61 | 25.02 |

What I claim is:

1. A spin-draw process for producing fully drawn polyamide filaments, whereby spontaneous crimp is imparted to the filaments as they are being drawn, comprising:

(a) extruding a fiber-forming polyamide through orifices of a spinneret at a given extrusion rate ($E_R$) to form filaments which cool as they move away from the spinneret, (b) passing said filaments over a quench roll before they are completely solidified but after they have cooled to a temperature below their stick temperature, wherein said roll (1) has a surface temperature ($T_R$) which is between 20° C. and 180° C. and lower than the average temperature at the center of said filaments, thereby cooling said filaments on one side, (2) is rotating at a peripheral speed ($S_1$) and (3) is positioned a a distance (d) below said spinneret, (c) drawing said filaments at a draw ratio (DR) between 1.5:1 and 6:1 as they leave said roll by withdrawing said filaments from said roll at a speed ($S_2$) which is at a speed sufficient to provide said draw ratio, and (d) collecting said filaments in the form of a yarn, said process being characterized in that ($E_R$), (d), ($T_R$) and (DR) are correlated to obtain filaments having sufficient spontaneous crimp to provide a yarn having at least 6.05% cold bulk.

2. The process of claim 1 wherein said polyamide is hexamethylene adipamide.

3. The process of claim 2 wherein $T_R$ is between 30° and 100° C.

4. The process of claim 2 wherein said yarn is further characterized in having at least 18% hot bulk.

5. The process of claim 3 wherein (d) is in the range of 9.5 inches to 16 inches.

* * * * *